US005141114A

United States Patent [19]

Cate, Jr. et al.

[11] Patent Number: 5,141,114

[45] Date of Patent: Aug. 25, 1992

[54] MATERIAL HANDLING METHOD AND APPARATUS

[75] Inventors: Lyle L. Cate, Jr., Washington; David L. Cate, Richmond; Kim W. Wright, St. Clair Shores; Robert W. Binienda, Northville, all of Mich.

[73] Assignee: Cate Metal Products, Inc., Mt. Clemens, Mich.

[21] Appl. No.: 569,190

[22] Filed: Aug. 16, 1990

[51] Int. Cl.[5] ..... A47F 7/00

[52] U.S. Cl. ..... 211/13; 211/162; 206/448

[58] Field of Search ..... 211/13, 162, 41; 29/897; 206/325, 454, 448, 335, 451

[56] References Cited

U.S. PATENT DOCUMENTS

| | | | |
|---|---|---|---|
| 2,129,951 | 9/1938 | Loney et al. | 211/13 |
| 2,632,567 | 3/1953 | Richtmyer | 211/13 |
| 2,954,197 | 9/1960 | Laird | 211/13 X |
| 2,962,167 | 11/1960 | Storey et al. | 211/13 |
| 3,746,176 | 7/1973 | Kotlar | 211/13 |
| 4,074,823 | 2/1978 | Pater et al. | 206/454 X |
| 4,493,421 | 1/1985 | Matthewson et al. | 211/13 |
| 4,733,781 | 3/1988 | Gerlach | 206/454 X |
| 4,747,495 | 5/1988 | Hoss | 211/13 |
| 4,871,075 | 10/1989 | Moulds | 211/13 |
| 4,921,100 | 5/1990 | Krause | 206/448 |

*Primary Examiner*—David M. Purol
*Attorney, Agent, or Firm*—Krass & Young

[57] ABSTRACT

A method and apparatus for handling sheet metal stampings such as automotive body panels. A rack is disclosed in which a plurality of runner assemblies are positioned proximate the floor of the rack with each runner assembly including a galvanized steel base member secured to the floor structure of the rack and a top member secured to the base member. The top member includes a galvanized steel substrate and a cladding applied to the upper face of the substrate. The cladding comprises a lubricous material such, for example, as a polypropylene so that the cladding not only provides a mar-resistant surface to protect the finish of the sheet metal stamping but further provides a low friction lubricous surface to facilitate the sliding movement of the stamping along the runner as the stamping is moved into and out of the associated rack structure.

15 Claims, 3 Drawing Sheets

10
11
12
14
16
16a
18
18a
20
22
24
26
26a
28
28a
30
32
32a
32b
34
36
39
40
42
52
52a
52b

MATERIAL HANDLING METHOD AND APPARATUS

BACKGROUND OF THE INVENTION

This invention relates to methods and apparatus for handling and transporting articles and more particularly to methods and apparatus especially suitable for handling sheet metal stampings employed in the fabrication of motor vehicle bodies.

Modern day motor vehicles comprise a base or skeletal structure commonly called a body in white to which a series of sheet metal stampings are suitably attached to form the final exterior configuration of the vehicle body. These stampings include, for example, hoods, deck lids, roof panels, quarter panels and doors. These stampings are produced by stamping facilities in mass quantities and it is necessary to receive the stampings emerging from the stamping facilities and transport them to the site of the vehicle body assembly. During such transport it is imperative that the stamping be protected from both surface or cosmetic damage as well as from stresses such as might produce structural damage to the stamping. It is also imperative that the stampings be loaded and unloaded into and from the associated material handling apparatus in a minimum of time and with a minimum of effort, and with a minimum amount of damage to the stampings.

Various methods and apparatus are currently in use to transport sheet metal stampings within and between automotive facilities. Typically, these apparatus comprise various forms of racks in which the stampings are loaded and in which the stampings are transported to the cite of the vehicle body assembly. Whereas these prior art rack structures have been generally satisfactory, they are often difficult to load and unload and the articles or stamping being handled are often damaged during the course of the loading or unloading.

SUMMARY OF THE INVENTION

This invention is directed to the provision of an improved method and apparatus for handling and transporting articles, particularly sheet metal stampings.

More particularly, this invention is directed to the provision of an improved method and apparatus for handling sheet metal stampings employed in the fabrication of motor vehicle bodies.

According to an important feature of the invention methodology, a metallic runner is provided defining an elongated guide and support surface; a cladding of lubricous material is provided on the runner surface to provide an elongated lubricous guide and support surface; the runner is incorporated into a rack structure; and an article is loaded into the rack by sliding the article along the lubricous guide and support surface to a storage position within the rack on the lubricous surface. This methodology allows the runner to provide guidance and support for the article as well as to facilitate the lubricous movement of the article into and out of the rack.

The cladding may comprise, for example, a lubricous polymer material, more preferably an olefin polymer material, and most preferably a polypropylene polymer material.

The invention methodology also encompasses a method for forming a runner for use in a material handling structure. According to this methodology, an elongated metallic runner is formed having an elongated mounting portion to facilitate mounting of the runner in the material handling structure and defining an elongated material handling surface remote from the mounting portion; and a cladding of a lubricous material is applied on the elongated material handling surface to provide an elongated lubricous handling surface to facilitate the loading and unloading into and out of the material handling structure. This methodology provides a runner for incorporation into a material handling structure such as a rack to facilitate the loading and unloading of the rack.

According to a further feature of the invention methodology, the runner forming step comprises forming the elongated mounting portion in the form of an elongated spine having a lower mounting surface forming the bottom of the runner for attachment of the runner to the material handling structure, and forming the material handling surface as an upwardly facing elongated surface forming the top of the runner.

According to a further feature of the invention methodology, a supply of flat laminar strip material is provided having a metallic substrate and a lubricous cladding on the upper face of the substrate; a supply of a flat metallic strip material is provided; the laminar strip is formed into a plurality of elongated top members; the metallic strip is formed into a plurality of elongated base members; and each top member is secured to a respective bottom member to form a runner with the base member positioned beneath the top member to provide a mounting structure for the runner and the lubricous cladding upwardly disposed to provide an elongated lubricous guide and support surface to facilitate sliding movement of articles along the runner during the loading and unloading of a material handling structure employing the runner.

According to a feature of the invention apparatus, a material handling rack is provided including a frame structure; a plurality of metallic runners each defining an elongated guide and support surface and each having a cladding of lubricous material on the surface to provide an elongated lubricous guide and support surface; and means mounting the runners in the frame structure in spaced, parallel, side by side relation to define a plurality of spaced parallel elongated lubricous guide and support surfaces for respective slidable receipt of a series of articles to be stored or transported.

According to a further feature of the invention apparatus, each elongated metallic runner has an elongated mounting portion to facilitate mounting of the runner in the material handling structure; the mounting portion comprises a metallic spine member having a lower mounting surface forming the bottom of the runner for attachment of the runner to the material handling structure; the runner further includes an elongated metallic top member secured to and over the spine member; and the cladding of lubricous material is secured to the upper face of the metallic top member.

DETAILED DESCRIPTION OF THE PREFERRED EMBODIMENT

Figures 1, 2, 3:
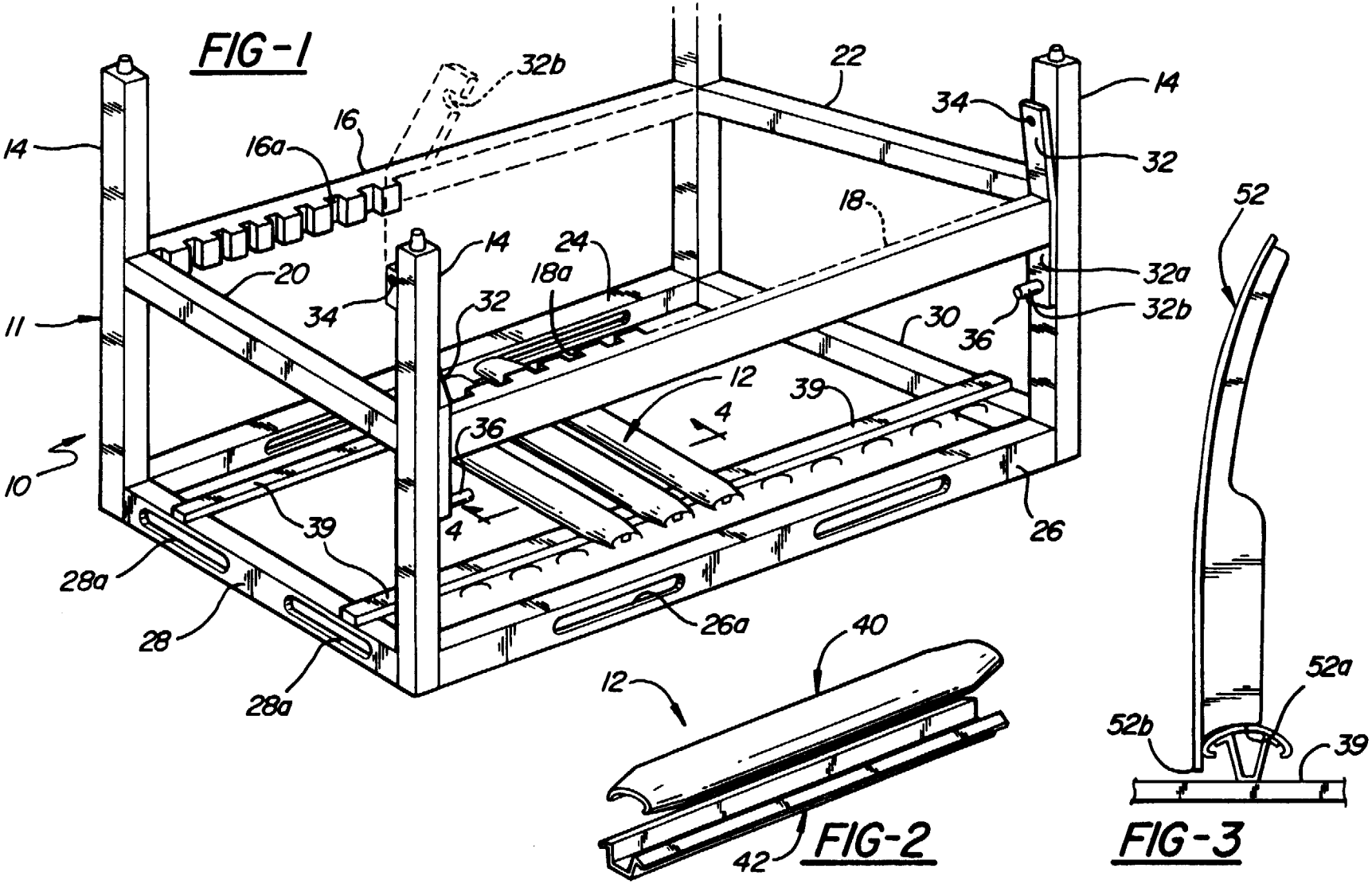
FIG. 1 is a perspective view of a rack structure according to the invention.
FIG. 2 is an exploded view of a runner assembly employed in the rack of FIG. 1.
FIG. 3 is a fragmentary view showing a portion of the rack structure of FIG. 1 including a runner assembly with a vehicle door supported thereon.
Figure 4:
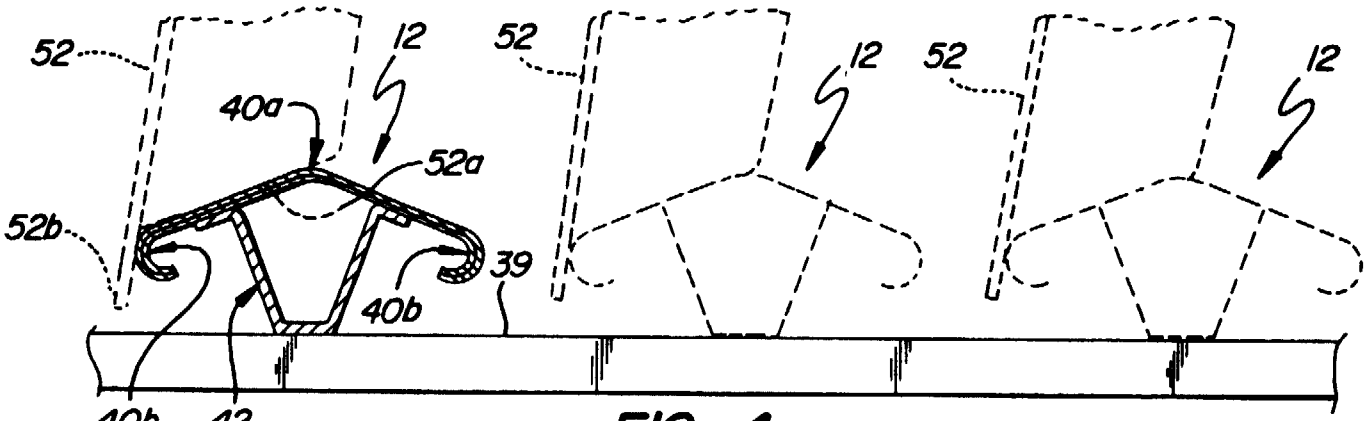
FIG. 4 is a cross-sectional view taken on line 4—4 of FIG. 1.

The invention method and apparatus is embodied in a rack 10, seen in FIG. 1, comprising a frame structure 11 and a plurality of runner assemblies 12.

Frame structure 11 is of generally rectangular cage configuration and includes corner posts 14, upper side rail members 16 and 18, upper end rail members 20 and 22, lower side rail members 24 and 26, and lower end rail members 28 and 30.

Rail members 16, 20, 22, 24, 26, 28 and 30 are rigidly secured, as by welding, to the corner posts 14 whereas side rail 18 is preferably secured to the associated corner posts 14 in a pivotal manner so as to allow access to the interior of the rack structure. Specifically, side rail 18 is mounted between arms 32 which are pivotally mounted at 34 to the corner posts so as to enable the side rail to be moved between the closed, solid line position of FIG. 1 to the raised position of FIG. 1 (as indicated by the dotted line position of one of the arms 32). The lower ends **32*a* of the arms 32 include notches 32*b* for coaction with stop pins 36 carried by corner posts 14 to define and delimit the lower closed position of the side rail. Latching means (not shown) are also provided to maintain the side rail in its closed position. Openings 28*a* are provided in rail member 28 for access by the forks of a forklift truck and similar openings 26*a* are provided in side rail member 26. Similar forklift openings are provided in end rail member 30 and side rail member 24** so as to allow the convenient lifting and transporting of the rack assembly by forklift equipment in known manner.

Side rail member 16 defines a plurality of notches **16*a* for guidance and support of articles stored within the rack and side rail member 18 similarly defines a series of notches 18*a* for guidance and support of articles stored within the rack with the side rail in its lowered or closed position. Rack 10 further includes a pair of bars 39 secured to and extending between lower end rails 28 and 30 in parallel spaced relation and in underlying relation to runner assemblies 12**.

Each runner assembly 12 includes a top member 40 and a base member 42.

Top member 40 is a laminar member and includes a metallic substrate 44 such, for example, as hot dipped galvanized steel and a cladding 46 of a lubricous material adhesively secured to the upper face of substrate 44.

Cladding 46 preferably comprises a polymer material such, for example, as an olefin polymer and particularly a polypropylene polymer. For example, cladding 46 may comprise a polypropylene film material available from Pre Finish Metals Inc. of Chicago, Ill. as Code BC20-192 and the cladding may be adhesively secured to the galvanized steel substrate by an adhesive available from Pre Finish Metals Inc. as Part No. 10-7515-07155-000.

The galvanized substrate 44 may, for example, have a thickness of 0.068 inches and the polypropylene cladding 46 may have a thickness of 0.010 inches although the relative thicknesses of the layers 44 and 46 may vary considerably and the cladding may in some applications have a thickness substantially equal to the thickness of the galvanized substrate.

Top member 40 includes a main body portion **40*a* in the form of a shallow downwardly opening structure and arcuate end portions 40*b* curving outwardly and downwardly from the respective end edges of main body portion 40*a***.

Base member 42 is formed of hot dipped galvanized sheet steel and includes a U-shaped main body portion **42*a* and flange portions 42*b*. Main body portion 42*a* includes side walls 42*c* and a bottom wall 42*d*. Flange portions 42*b* extend outwardly from the upper edges of the respective side walls 42*c*. Base member 42** may have a thickness, for example, of 0.068 inches.

Base member is secured to top member 40 in a clinching operation in which portions of the substrate 44 of the top member 40 are clinched to a respective flange portion **42*b* of the base member in known manner to form a series of clinch joints 50 spaced longitudinally along the runner assembly so as to fixedly and securedly attach the top member 40 to the base member 42** with the top member in overlying relation to the base member.

Figure 5:
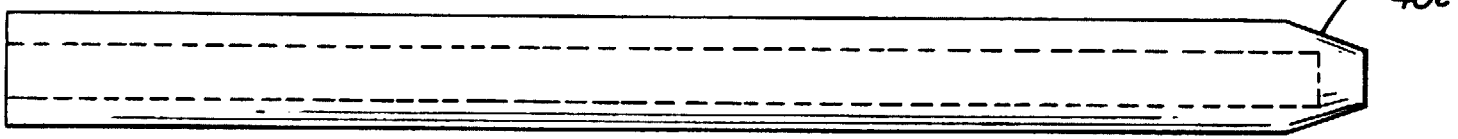
FIG. 5 is a plan view of the runner assembly.
Figure 6:
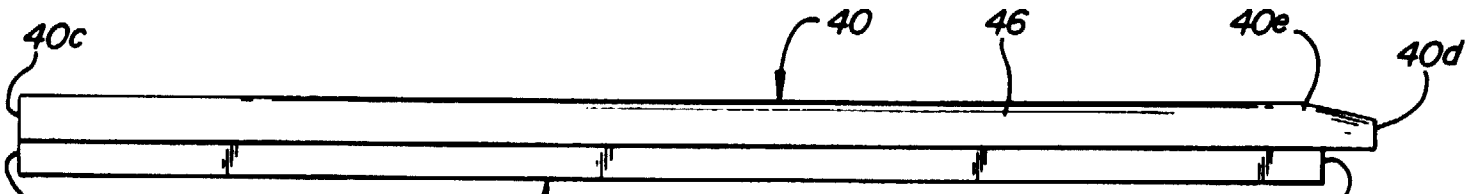
FIG. 6 is a side view of the runner assembly.
Figure 7:
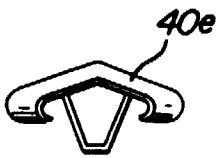
FIG. 7 is an end view of the runner assembly.

The base member 42 is somewhat shorter than top member 40 so that, as best seen in FIGS. 5 and 6, with one end **42*e* of base member 42 positioned even with one end 40*c* of top member 40, the opposite end 40*d* of the top member extends beyond the opposite end 42*f* of the base member. The end of top member proximate end 40*d* is swaged or tapered to form a leading, tapered front end portion 40*e***.

A plurality of runner assemblies 12 are mounted on bars 39 of rack frame structure 11 in side by side parallel spaced relation with each rail assembly extending from a location proximate side rail 24 to a location proximate side rail 26 and with its tapered end portion **40*e* proximate side rail 26. The rail assemblies 12 are secured to bars 39 by welding the bottom walls 42*d* of the base members 42 to the upper faces of the bars 39**.

With the runner assemblies 12 thus positioned within frame structure 11, and with upper side rail 18 in its raised position sheet metal stampings, such as automobile front doors 52 emerging from a suitable stamping press, may be loaded into the rack by sliding each door along the lubricous upper surface of a respective runner assembly with the lower edge **52*a* of the door sliding along the lubricous upper face of cladding 46, the lower door flange 52*b* sliding along the lubricous surface provided by an arcuate portion 40*b* of the top member, and the leading edge of the door guiding into a respective notch 16*a*. After the rack has been filled by sliding a door into association with each runner assembly, the rail 18 is pivoted downwardly to its solid line position of FIG. 1 whereupon the notches 18*a* respectively engage with trailing edges on the doors so as to securely position the doors within the rack. As the doors are loaded into the rack, the tapered front end surfaces 40*e* of the top members of the rail assemblies provide a pilot portion to facilitate the movement of the door into the space defined between adjacent runner assemblies so that the tapered end 40*e* serves a piloting operation as the door is moved onto and along the runner assembly. The lubricous upper surface provided by the polypropylene cladding 46** provides a lubricating film to facilitate the ready movement of the doors along the runner assemblies and the polypropylene cladding further guards against marring of the doors during the loading or unloading operations and during the transporting of the doors.

Figures 8, 9:
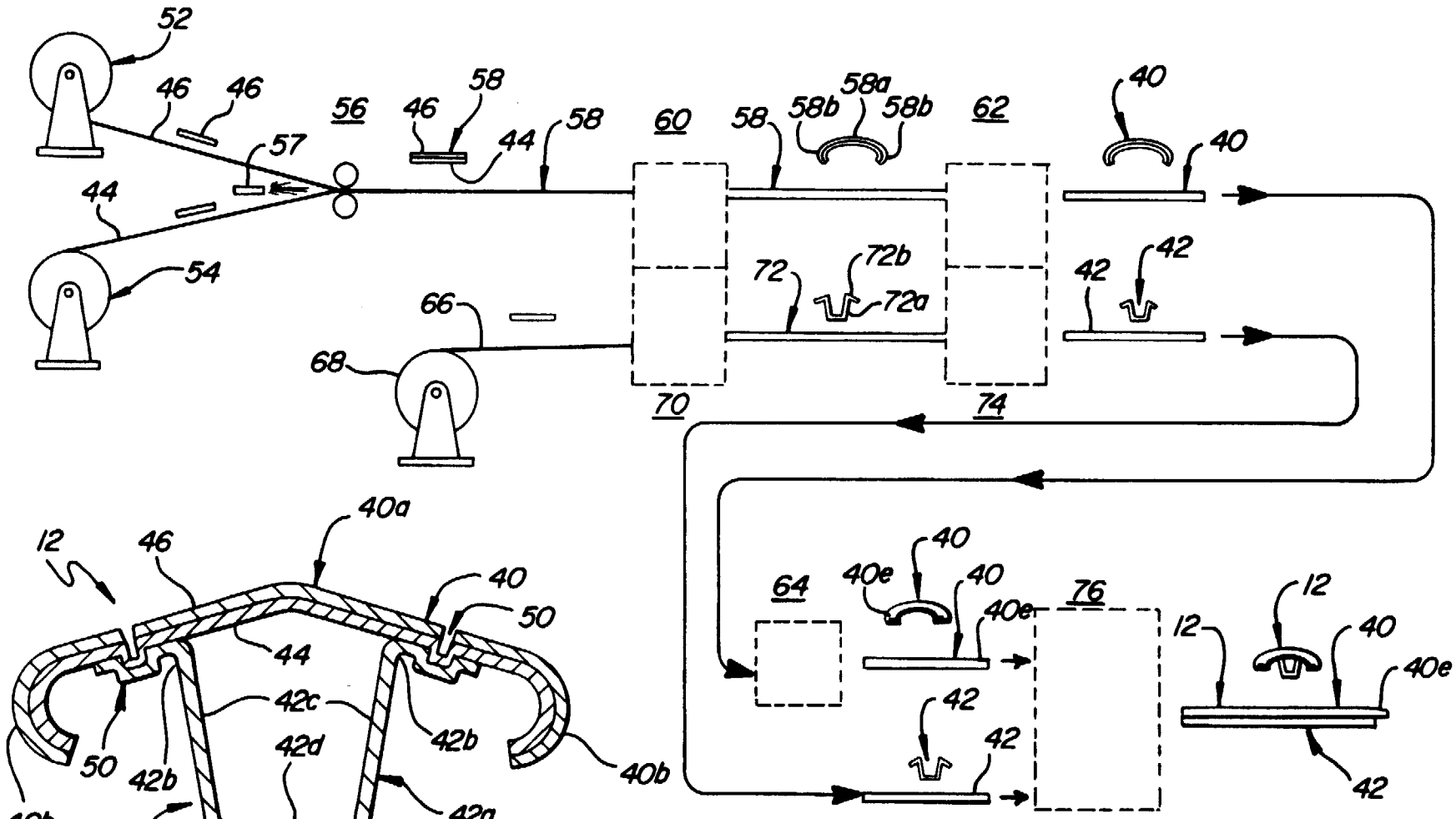
FIG. 8 is a cross-sectional view of the runner assembly.
FIG. 9 is a schematic view showing the invention methodology for forming a runner assembly.

The invention methodology for forming the runner assemblies 12 is seen in FIG. 9. As seen in FIG. 9, a roll 52 of cladding material 46 in strip form is positioned adjacent a roll 54 of galvanized steel 44 in strip form; the cladding 46 from the roll 52 is fed to a station 56 where it is joined to the galvanized strip 44 from roll 54 in an adhesive bonding operation, utilizing a spray gun 57, to form a flat laminar strip material 58 having a metallic substrate 44 and a cladding overlay 46; the laminar strip 58 is fed to a roll forming mechanism 60 where it is roll formed to form a continuous laminar strip 58 having a main body portion 58*a* and arcuate end portions 58*b*; the formed laminar strip is fed to a suitable cutter 62 where it is successively cut into a series of segments each constituting a top member 40; each top member 40 is fed through a swaging machine 64 where the front end 40*e* of the top member is swaged and tapered to form the leading tapered end of the top member; simultaneously a strip 66 of galvanized metal is unwound from a coil 68 and fed to a roll former 70 where it is configured to form a continuous strip 72 having a U-shaped main body portion 72*a* and flange portion 72*b*; the formed galvanized strip 72 is fed to a cutter 74 where the sheet is successively severed to form a successive series of base members 42; and the base members 42 are successively fed to a clinching machine 76 where each base member is clinched to a respective top member 40 to form a runner assembly 12 for positioning in side by side relation in rack frame structure 11 in the manner previously described.

The invention will be seen to provide an improved method and apparatus for material handling applications and, more particularly, will be seen to provide an improved method and apparatus for handling the sheet metal stampings commonly encountered in the automobile body assembly process. The described apparatus and methodology allows the sheet metal stampings to be readily and quickly loaded onto a suitable rack structure with a minimum of effort, because of the low friction lubricous surface provided by the cladding on the runner assemblies, and with a minimum of scuffing or marring of the sheet metal, because of the anti-marring properties of the cladding on the runner assemblies.

Whereas a preferred embodiment of the invention has been illustrated and described in detail, it will be apparent that various changes may be made in the disclosed embodiment without departing from the scope or spirit of the invention.

We claim:

1. A method of handling an article to be stored and transported and having a substantial length comprising the steps of:

providing a longitudinally extending metallic runner defining an elongated guide and support surface extending substantially continuously for a distance corresponding generally to length of the article;

providing a cladding of lubricous material on said runner surface over substantially the entire length of the runner surface to provide an elongated lubricous guide and support surface;

incorporating said runner into a rack structure; and loading the article to be stored and transported into said rack structure by sliding the article lengthwise along said elongated lubricous guide and support surface to a storage position within said rack on said lubricous surface.

2. A method according to claim 1 wherein:

said step of providing a cladding of lubricous material comprises providing a cladding of a lubricous polymer material.

3. A method according to claim 2 wherein:

said step of providing a cladding of lubricous material comprises providing a cladding of an olefin polymer material.

4. A method according to claim 3 wherein:

said step of providing a cladding of lubricous material comprises providing a cladding of a polypropylene material.

5. A material handling rack comprising:

a frame structure;

a plurality of elongated metallic runners each defining a flat elongated guide and support surface extending for substantially the entire length of the runner and each having a cladding of lubricous material on said surface to provide a flat elongated lubricous guide and support surface extending for substantially the entire length of the runner; and means mounting said runners in said frame structure in spaced, parallel side by side relation to provide a plurality of spaced parallel elongated flat lubricous guide and support surfaces so that the rack may be loaded by sliding articles to be stored or transported along the elongated flat lubricous guide and support surfaces.

6. A rack according to claim 5 wherein:

said cladding comprises a cladding of a lubricous polymer material.

7. A rack according to claim 6 wherein:

said cladding comprises a cladding of an olefin polymer material.

8. A rack according to claim 7 wherein:

said cladding comprises a cladding of a polypropylene material.

9. A method of forming a runner for use in a material handling structure including the steps of:

providing an elongated strip of metallic material defining an elongated flat surface extending for the entire length of the strip;

applying a cladding of a lubricous material on said flat elongated surface of said metallic strip to provide a laminar composite strip having a flat elongated lubricous surface extending for the entire length of the strip; and forming said composite strip into a runner in a roll forming operation to facilitate loading and unloading of articles into and from the material handling structure.

10. A runner assembly for use in a material handling structure comprising:

an elongated metallic runner having a elongated mounting portion to facilitate mounting of the runner in the material handling structure and defining a flat elongated material handling surface remote from and above said mounting portion and extending in a flat fashion and parallel to said mounting portion for substantially the entire length of said runner; and a cladding of a lubricous material on said flat elongated material handling surface to provide a flat elongated lubricous material handling surface extending for substantially the entire length of said runner to facilitate the loading and unloading of articles into and out of the material handling structure.

11. A runner assembly according to claim 10 wherein:

said cladding comprises a cladding of a lubricous polymer material.

12. A runner assembly according to claim 11 wherein:

said cladding comprises a cladding of an olefin polymer material.

13. A runner assembly according to claim 12 wherein:

said cladding comprises a cladding of a polypropylene material.

14. A runner assembly according to claim 10 wherein:

said mounting portion of said runner comprises an elongated metallic spine member having a lower mounting surface forming the bottom of said runner for attachment of the runner to the material handling structure;

said runner further includes an elongated metallic top member secured to and over said spine member; and said cladding of lubricous material is secured to the upper face of said metallic top member.

15. A runner assembly according to claim 14 wherein:

said top member is secured to said spine member by clinching.

* * * * *